United States Patent [19]

Wang

[11] 4,253,917

[45] Mar. 3, 1981

[54] METHOD FOR THE PRODUCTION OF COPPER-BORON CARBIDE COMPOSITE

[75] Inventor: Chih-Chang Wang, Lexington, Mass.

[73] Assignee: Kennecott Copper Corporation, New York, N.Y.

[21] Appl. No.: 69,263

[22] Filed: Aug. 24, 1979

[51] Int. Cl.[3] ..... C25D 15/00; C25D 7/04

[52] U.S. Cl. ..... 204/16; 204/26

[58] Field of Search ..... 204/3, 4, 12, 16, 27, 204/40, 9, 26

[56] References Cited

U.S. PATENT DOCUMENTS

| | | | |
|---|---|---|---|
| 779,639 | 1/1905 | Case | 204/16 |
| 3,061,525 | 10/1962 | Grazen | 204/3 |
| 3,537,960 | 11/1970 | Esola | 204/16 |
| 3,591,466 | 7/1971 | Heiman | 204/16 |
| 3,716,461 | 2/1973 | Ahmad | 204/16 |
| 3,768,256 | 10/1973 | Butter | 204/16 |

FOREIGN PATENT DOCUMENTS

| | | | |
|---|---|---|---|
| 651826 | 11/1962 | Canada | 204/16 |
| 128448 | 12/1900 | Fed. Rep. of Germany | 204/16 |
| 105937 | 9/1976 | Japan | 204/16 |

*Primary Examiner*—T. M. Tufariello

*Attorney, Agent, or Firm*—John L. Sniado; Anthony M. Lorusso

[57] ABSTRACT

A process for manufacturing nuclear radiation shields consisting of neutron-absorbing boron carbide particles embedded in a heat-dissipating copper matrix. Copper is electroplated through a layer of loose, electrically non-conductive boron carbide particles on a metal substrate. The carbide particles may be deposited on the substrate while electroplating, and heat exchanger ductwork may be incorporated. To make cylindrical shields, a cylindrical metal substrate is rotated about its axis giving rise to centrifugal forces which hold the carbide particles on the inner surface and aid electrodeposition. A thermo-mechanical process is described in which boron carbide particles pre-encapsulated with copper are consolidated into a unitary mass on the inner surface of a heated cylindrical substrate with or without the aid of a roller within the cylinder.

15 Claims, 27 Drawing Figures

METHOD FOR THE PRODUCTION OF COPPER-BORON CARBIDE COMPOSITE

BACKGROUND OF THE INVENTION

This invention relates generally to processes for manufacturing nuclear radiation shields containing boron carbide ($B_4C$), and more particularly to methods by which plates and cylinders containing boron carbide particles embedded in a copper matrix can be economically manufactured. The primary use for such shield structures is in the fabrication of containers designed for storage, disposal or transportation of nuclear waste materials and other radioactive substances. One of the known types of containers for nuclear waste materials comprises a plurality of cube-shaped boxes about 9" on a side. The 2–5 mm thick walls made of copper-boron carbide composites contain 20–50% boron carbide by weight. The boxes are embedded in aluminum which is poured (molten) around them and allowed to cool forming a cellular structure.

Boron carbide is the filler of choice because of its high capture cross-section for neutrons. However, absorption of neutrons by boron carbide produces heat. Copper is chosen for the matrix in which the boron carbide particles reside because copper's high specific heat and high thermal conductivity enables it to dissipate a large amount of heat with relatively low temperature rise. Aluminum, in comparison, is not as favorable and has a lower melting point. It is not desirable to use aluminum alone.

The ideal boron carbide-filled copper plate material for use in fabricating these and other types of containers would be a substantially pure voidless matrix of copper metal tightly bonded to a uniformly dispersed boron carbide phase consisting of boron carbide particles arranged within the copper matrix such that no straight line passing through the plate fails to impinge upon a carbide particle. If there is too little copper, a product with voids and diminished structural integrity results. With too much copper the boron carbide particles are too sparsely distributed.

The different properties of boron carbide and copper present problems in fabricating boron carbide-filled copper. One process for manufacturing composite plates involving several separate procedures is described in copending U.S. patent application Ser. No. 901,843 entitled "Copper-Boron Carbide Composite and Method for Its Production", filed May 1, 1978, by C. C. Wang and assigned to the assignee of the present application. In one embodiment of the process, a film of electroless copper is bonded to the boron carbide. Next a relatively thick electrodeposited copper layer is applied to the film. Finally, the copper encapsulated particles, referred to herein as "nodules", are thermomechanically consolidated to produce shield structures by hot rolling or hot pressing, with or without sintering, with a copper to boron carbide volume ratio of 0.3–4.0, typically 1.0.

Boron carbide is commercially available in various particle sizes, for example, from the Carborundum Company of Niagra Falls, N.Y. The electrical resistivity of this material is on the order of $10^4$ to $10^8$ microohms per centimeter. Electrodeposition does not usually lend itself to coating nonconductive materials.

SUMMARY OF THE INVENTION

The general object of the invention is to improve the fabrication of boron carbide-filled copper sheet materials for nuclear waste containers and the like.

In a one-step process, copper is directly electroplated through a layer of loose electrically nonconductive unprecoated boron carbide particles resting on a metal substrate. To produce plates, the electrodeposition is carried out in a vertical electrolytic cell. As the electrodeposition proceeds, the deposited copper progressively fills the interstices among the irregularly shaped boron carbide particles starting at the substrate, progressing through the thickness of the particulate layer and ending with a finish coat of pure copper. The process is improved by depositing boron carbide particles into the substrate continuously or at intervals while electroplating.

Cylindrical shields of similar composition can be produced by spreading a layer of boron carbide particles around a cylindrical substrate on the inside surface of a cylinder, placing a copper anode coaxially within the cylinder, filling the cylinder with the appropriate electrolyte and rapidly rotating the cylinder about its axis while electroplating so that centrifugal force not only holds the particles in place but also aids the electroplating process. Cooling (or heating) ductwork, preferably copper tubing, can be prearranged within the particulate layer so that it is incorporated into the plated composite layer.

Another technique for manufacturing cylindrical radiation shields employs nodules composed of boron carbide particles which have been previously individually encapsulated with copper, as described, for example, in the above-mentioned application. The nodules are spread about a metal substrate on the inner surface of a cylinder, and the cylinder is heated while rapidly rotating about its axis. The centrifugal force and heat consolidate the nodules into a composite cylindrical mass. A roller can also be placed within the cylinder for thermomechanical consolidation.

Figure 1:
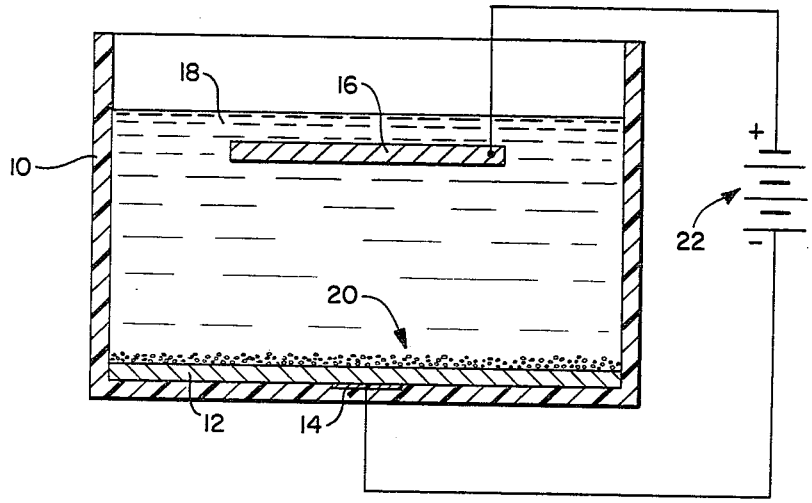
FIG. 1 is a schematic drawing of a vertical electroplating cell according to one aspect of the invention.
Figure 2A:
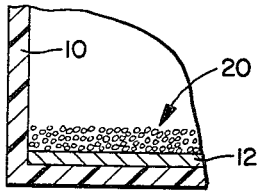
Figure 2B:
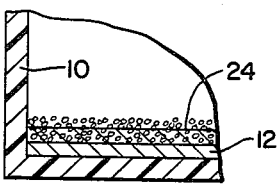
Figure 2C:
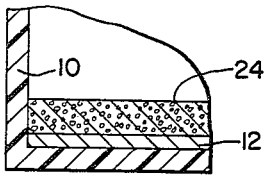
Figure 2D:
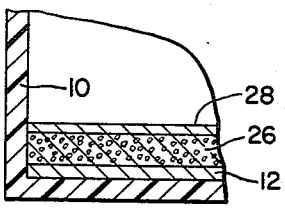

FIG. *2a–2d* are schematic representations of fragmentary sectional views of four successive stages in the electrodeposition process with the cell of FIG. 1.

Figure 3:
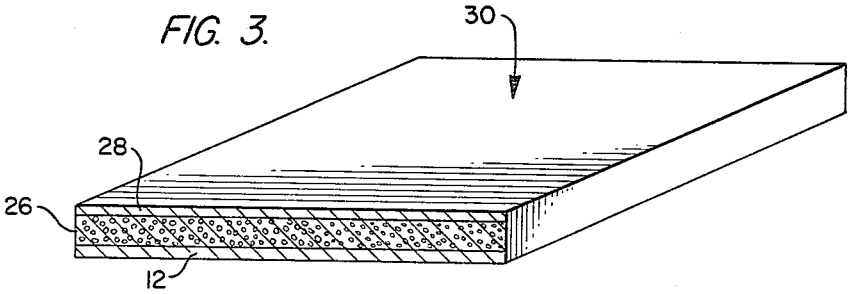

FIG. 3 is a schematic representation of an isometric sectional view of a radiation absorbing plate of the type produced by the cell of FIG. 1.

Figure 4:
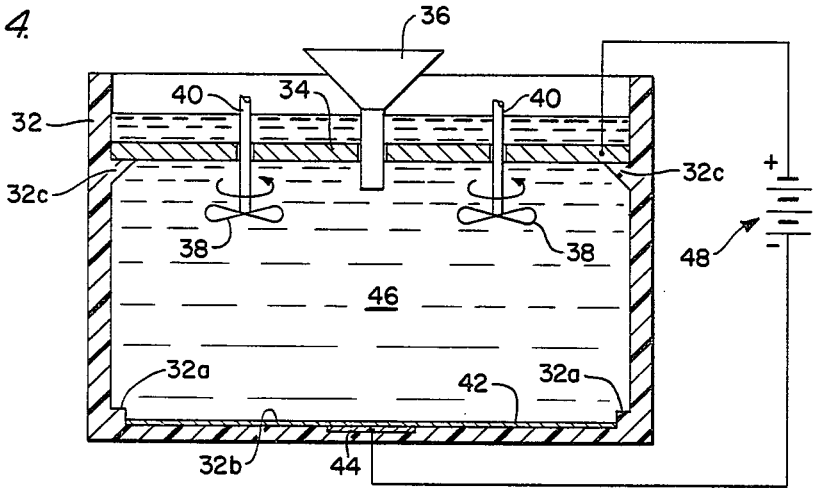

FIG. 4 is a schematic drawing of an embodiment of the vertical electroplating cell of FIG. 1 with stirrers for uniformly dispersing boron carbide particles in the electrolyte.

FIGS. *5a–5d* are schematic representations of fragmentary sectional views of successive stages in the electrodeposition process within the cell of FIG. 4.

Figure 6:
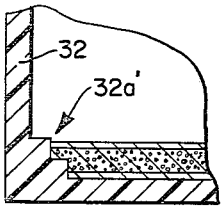

FIG. 6 is a schematic fragmentary detail sectional view illustrating another embodiment of the wall of the cell of FIG. 4.

Figure 7:
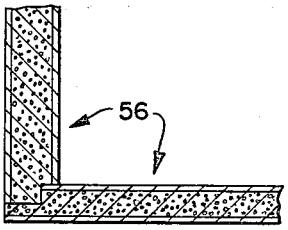

FIG. 7 is a schematic fragmentary sectional view of a joint between two plates produced by the cell of FIG. 4.

Figure 8:
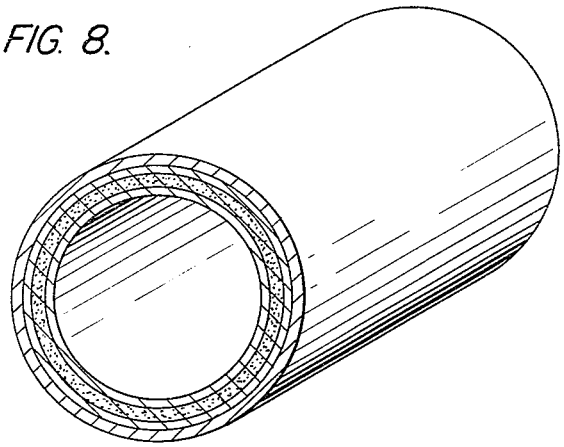
Figure 9:
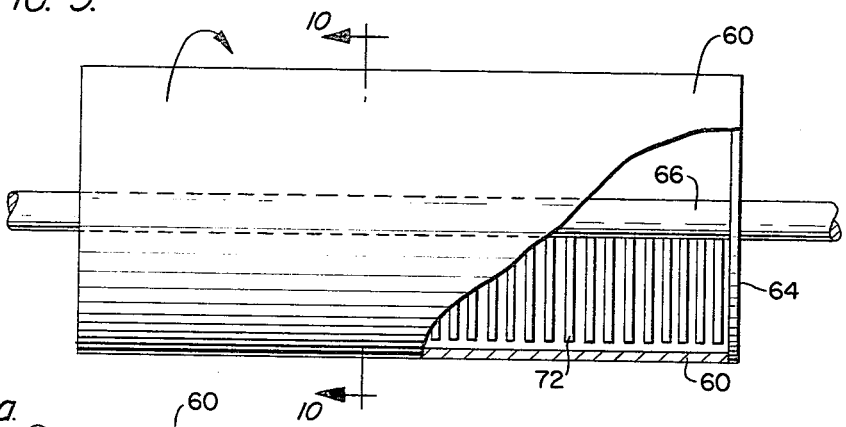

FIG. 8 is a schematic isometric sectional view illustrating a cylindrical shell produced by the apparatus of FIG. 9 in accordance with the invention.

FIG. 9 is a schematic side view of a rotatable electrodeposition cylinder with a portion broken away to show a distribution rake.

Figure 10A:
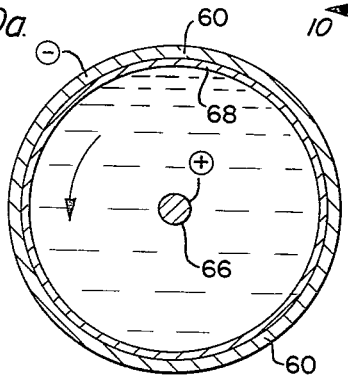
Figure 10B:
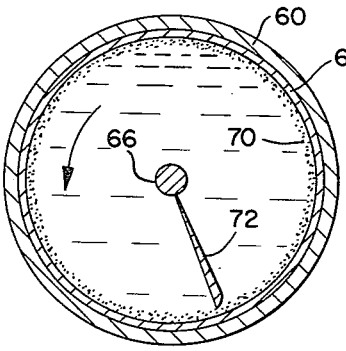
Figure 10C:
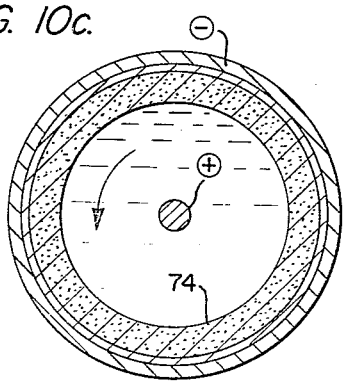

FIGS. 10*a*–10*d* are four coaxial views of the cylindrical cell apparatus of FIG. 9 taken along lines 10—10 of FIG. 9 with the rake present only in FIG. 10*b*.

Figure 11:
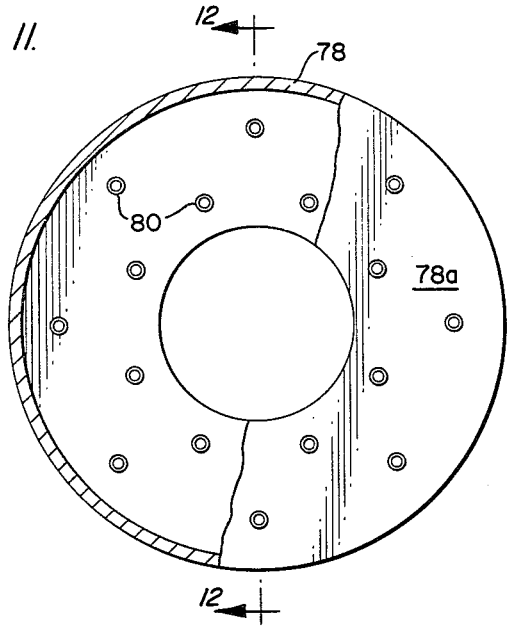

FIG. 11 is a schematic end view of a cylindrical cell with portions broken away showing the distribution of ducts.

Figure 12:
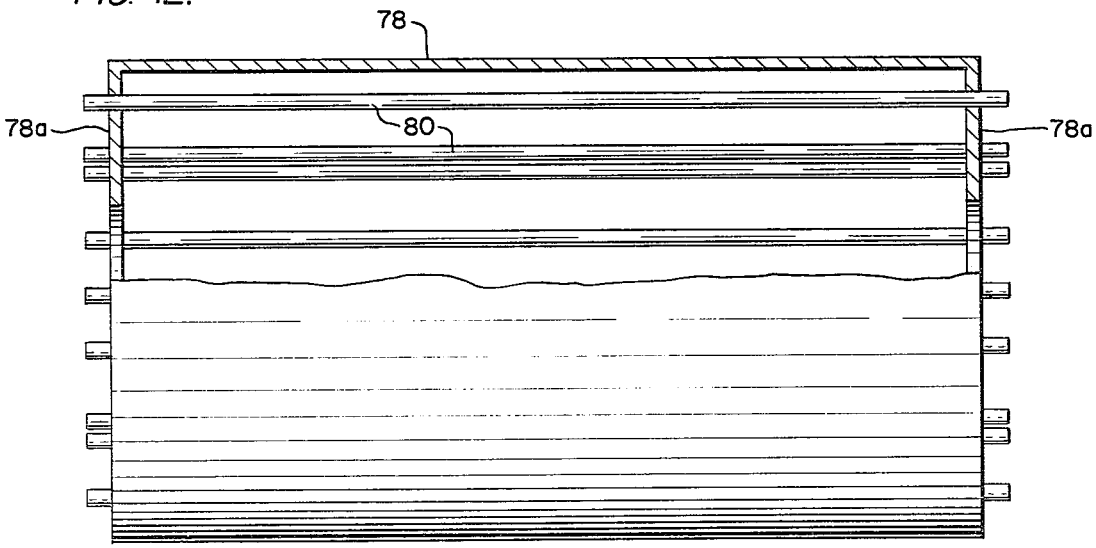

FIG. 12 is a schematic sectional view along lines 12—12 of FIG. 11.

Figure 13:
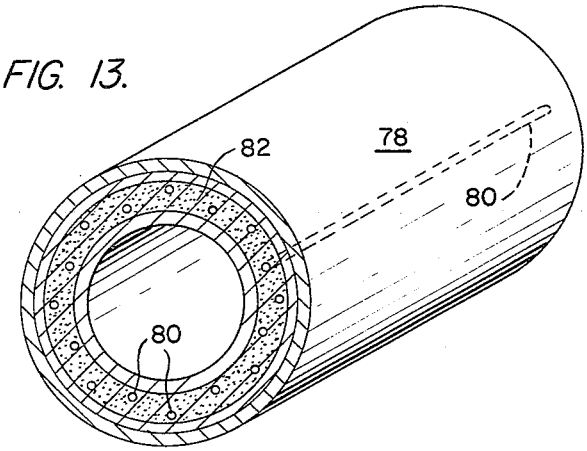

FIG. 13 is a schematic isometric sectional view of a cylindrical composite produced by the apparatus of FIGS. 11 and 12.

Figure 14:
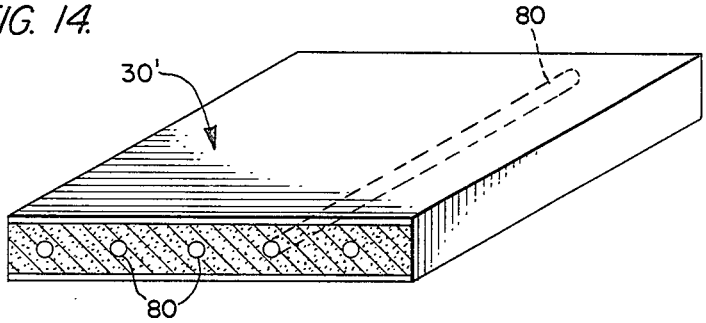

FIG. 14 is a schematic isometric view of a composite plate with similar ductwork.

Figure 15:
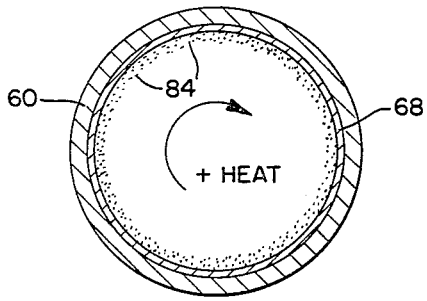

FIG. 15 is a schematic sectional view of cylindrical apparatus for consolidating boron carbide-filled copper nodules.

Figure 16:
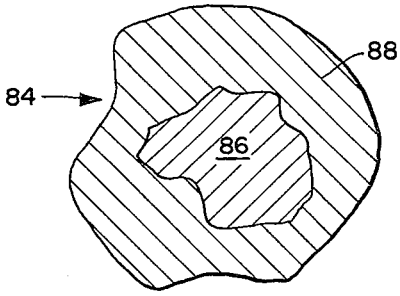

FIG. 16 is a schematic sectional view of a boron carbide particle precoated with a layer of copper.

Figure 17:
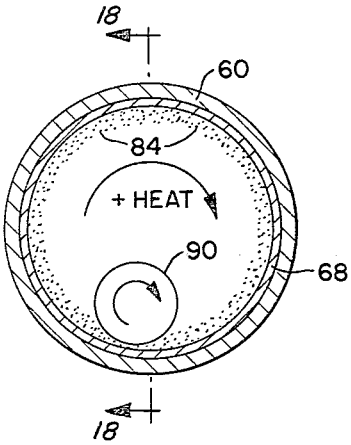

FIG. 17 is a schematic sectional view of cylindrical apparatus for consolidating boron carbide-filled copper nodules with the aid of a roller.

Figure 18:
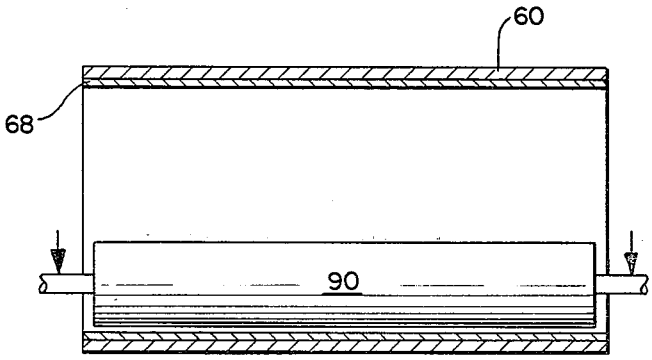

FIG. 18 is a schematic view of the apparatus illustrated in FIG. 17 taken along lines 18—18.

DETAILED DESCRIPTION OF A PREFERRED EMBODIMENT

An electrolytic entrapment technique has been discovered that can be used to intimately coat and bond the boron carbide particles together in a copper matrix even though the carbide particles themselves are almost wholly nonconductive. As illustrated schematically in FIG. 1, a vertical rectangular or cylindrical electrolytic cell 10 of chemically nonreacting electrically nonconductive material having an open top receives a removable bottom plate or layer 12 of metal such as stainless steel or, preferably, copper, to form an electrically conductive substrate in electrical contact with the cathode contact 14 in the bottom of the cell. The substrate 12 forms the plating cathode. A copper anode 16 is mounted in the cell directly above the cathode substrate 12. The electrolyte 18 is a copper ion-containing aqueous solution, for example, of copper sulphate and sulfuric acid. A thin layer 20 of unprecoated electrically nonconductive, loose boron carbide particles is deposited on the substrate 12 and held there by gravity. It is preferred to use a particle size close to about 1/16 inch. The copper anode 16 and cathode contact 14 are electrically connected to a battery or other source of direct current 22 so that a predetermined current density can be established between the copper anode 16 and substrate 12. Interstices among the particles define tortuous paths in the particulate layer through which the copper ions can migrate toward the cathode substrate 12.

As the electroplating proceeds, as illustrated in FIGS. 2*a*, 2*b*, 2*c*, and 2*d*, a copper mass 24 is deposited from the upper surface of the substrate 12 upwards through the interstices of the boron carbide particles. Repeated intermittent current reversal can be advantageously employed by repeatedly reversing the plating voltage while forming the composite layer. After sufficient copper has been deposited to cover all the particles in a composite layer 26, the electroplating proceeds to deposit a finish coat of pure copper 28. The resulting composite plate 30 shown in FIG. 3 consists of parallel metallic layers 12 and 28 sandwiching the composite layer 26. The plate 30 can be removed from the cell 10 since it does not adhere to the material of the cell itself. A box-shaped container (not shown) can be constructed using a plurality of plates 30 as side and end walls, the original size and shape of each plate being defined by the cell 10 and substrate 12.

It is preferred to add boron carbide particles gradually as the electroplating proceeds so that the particles interfere as little as possible with the rate of electrodeposition to promote void-free plating. One way to accomplish this is to deposit a very thin first layer of carbide particles on the substrate 12 and to electroplate through approximately the depth of the first layer. Then, another thin layer of particles is added and electroplated. The electroplating can be stopped while the next layer of carbide particles is deposited or it can proceed continuously. In this way, the plate is built up by gradual or continuous co-deposition of copper and boron carbide particles.

A preferred apparatus for carrying out the electroplating process is shown in FIG. 4. The apparatus forms a specific embodiment of the invention claimed in the present application. However, this embodiment per se is specifically claimed in copending application Ser. No. 69,526 by Thomas C. Wilder filed on the same day as the present application and assigned to the assignee of the present application as well.

In FIG. 4 an open box-shaped, vertical electrolytic cell 32 is made of a polyacrylic ester, such as that sold under the trademark LUCITE, or another chemically nonreacting electrically nonconductive material. The cell has a step or ledge 32*a* surrounding the floor 32*b* of the cell, which, in combination with the ledge 32*a*, defines the form or bed in which the electrodeposited mass is accumulated. The ledge 32*a* preferably has a square cross-section. The side walls of the cell 32 include integral supports 32*c* for a metallic anode 34 which is preferably a phosdeoxidized, apertured copper plate approximately coextensive with the horizontal cross-section of the cell. The anode 34 is fitted with a built-in funnel 36 which is received through an opening in the anode 34 approximately in the center of the cell. Distributed around the funnel 36 are a plurality of stirrers 38 fixed to the ends of respective rotatable shafts 40 extending in parallel through corresponding openings in the anode 34. Each of the stirrer shafts 40 may be coupled to a drive mechanism such as an electric motor. The cell is furnished initially with a removable metal substrate 42, sized to fit the bottom surface 32*b* of the cell, in electrical contact with the cathode contact 44 mounted in the bottom surface 32*b*. The substrate 42 may be stainless steel or copper or another metallic sheet material, preferably, a thin foil or mesh of copper or a sheet up to 1/16 inch in thickness. If structural strength is desired a larger plate can be used for the substrate 42. The entire cell 32 is filled to a level above the anode 34 with a conventional copper electrolyte solution 46 containing copper ions, for example, an aqueous solution of copper sulphate and sulfuric acid. The anode 34 is connected to the "positive" terminal of a battery or other source of direct current 48 and the cathode contact 44 is connected to the "negative" terminal of the source 48.

Figure 5A:
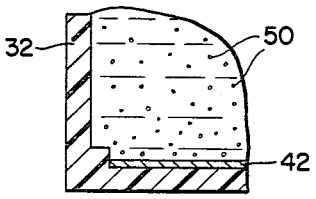
Figure 5B:
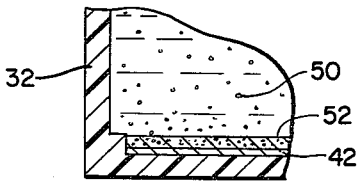
Figure 5C:
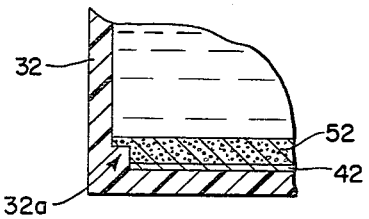
Figure 5D:
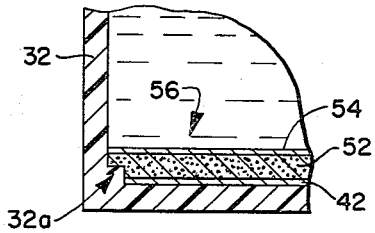

The technique preferably includes two phases of operation: first, the introduction of the boron carbide particles 50 (unprecoated, electrically nonconductive, grit size preferably at least 50 mesh) through the funnel 36 while agitating the electrolyte by means of the stirrers 38 and while electroplating an initial film of pure copper, and, secondly, ceasing agitation of the electrolyte when the particles are uniformly suspended therein and allowing the particles to settle onto the electroplating surface so that the particles become entrapped in the copper plating. The uniform suspension phase is illustrated in FIG. 5*a*. When the stirrers 38 are stopped the particles settle onto the surface while electroplating proceeds. As the copper level rises, the particles 50 become entrapped in the growing composite layer 52 as shown in FIG. 5*b*. The composite layer gradually builds up to a point (FIG. 5*c*) where it overlaps the ledge 32*a* of the cell so as to form a stepped edge on the resulting composite plate. After the carbide is incorporated in the composite layer 52, a finish coat 54 can be applied by continuing the electroplating at higher current density, if desired, as shown in FIG. 5*d*.

A double-step configuration 32*a* for the surrounding edge of the electroplating bed in the cell 32 is shown in FIG. 6. This configuration forms a more complex racheted edge for the resulting composite plate. Alternatively, the growth of the plate can be halted below the surface of the uppermost step to facilitate removal of the plate from the cell.

The plates 56 produced by the cell of FIG. 4 can be joined edge-wise at right angles as shown in FIG. 7 to form a box-like enclosure which may be further encapsulated in another material such as aluminum, if desired. The stepped edges prevent a straight seam between panels through which radiation can escape.

EXAMPLE 1

In the cell of FIG. 4 an electrolyte was used at ambient temperature containing 60 g/l of copper as copper sulfate with 75 g/l of sulfuric acid ($H_2SO_4$). The anode was an OFHC copper plate. The cathode substrate 42 was a copper screen approximately 8½ inches square, weighing about 84 grams. The current density was 10 amps per square foot, and the mesh size of the boron carbide was −170+270 cleaned. The timing of the two phases of operation in the cell of FIG. 4 was established so that preferably 10% of the boron carbide introduced the first time and 90% of subsequent carbide additions would be entrapped. The object of the experiment was to produce a thin, flexible $Cu/B_4C$ composite sheet.

The current was turned on at t=o and 2.8 grams of boron carbide were added to the electrolyte via the funnel 36 (FIG. 4). The stirrers were operated slowly for one minute and then stopped for 19 minutes. At t=20 minutes, 2.45 grams of boron carbide were introduced into the cell by the funnel 36 and stirred for 1 minute after which the stirrer was stopped again for 19 minutes while plating continued. This sequence of one minute of stirring followed by 19 minutes of settling was repeated about 10 times over a total plating period of about four hours. If this experiment about 20 weight percent boron carbide was used resulting in about 47 volume percent with good results indicated by microphotographs in which the porosity appeared to be low and the copper appeared to surround the particles well. Similar results were obtained using a three mil copper foil for the substrate 42.

EXAMPLE 2

In another experiment, 20 weight percent boron carbide was added all at the start and the stirrers 38 were turned on for an hour and off for an hour alternately through a timer over a period of about four days. The resulting sheet or composite plate was of lesser quality having some loose boron carbide and copper particles. This experiment indicated that boron carbide should preferably be added and stirred into the electrolyte at specified intervals throughout the plating process rather than all at once.

Further experiments have indicated that good results are achieved in the verticle cells described above when the loading of boron carbide (preferably at least 20 weight percent) is kept below 50 weight percent.

A preferred technique is to add about 10% of the total weight of boron carbide at a time and stir slowly for one minute and then stop stirring to allow settling for just over an hour (e.g., 80 minutes) between the carbide additions. With any given cell the optimum stirring time can be determined experimentally as that point at which the boron carbide particles attain an acceptably uniform distribution in the electrolyte. The length of time before the next addition of boron carbide particles is the amount of time necessary for a large percentage, for example, 90% of the particles, to have been electrolytically entrapped. It may be desirable to turn off the current for a brief interval coinciding with each subsequent addition of carbide particles and agitation of the electrolyte.

A cylindrical radiation shield 58, as shown in FIG. 8, can be produced by adapting the foregoing technique for use on a cylindrical substrate. The container comprises an outer cylindrical casing 60 and a boron carbide-filled coaxial interior copper layer 62 of uniform thickness bonded to the interior of the casing 60.

A cylindrical electrolytic entrapment technique is illustrated in FIGS. 9 and 10. The electrolytic cell is formed by cylindrical metal casing or drum 60 horizontally mounted for rotation about its axis. The inner surface of drum 60 forms the substrate cathode. The ends of the drum are sealed by circular plates 64. A cylindrical copper anode 66 is coaxially mounted within the drum and is axially coextensive therewith. The anode may be stationary or may rotate with the drum so as to obviate a rotary fluid-tight joint in the structure. The electrical connections are made by brushes, sliding contacts, or any other form of suitable conventional commutator (not shown). The interior of the drum 60 is filled with an electrolyte containing copper ions, like that used in the cells of FIGS. 1 and 4.

Employing the electrically conductive drum as a cathode surrounding a centrally mounted anode 66, an electrical circuit (not shown) establishes a potential difference such that plating current is passed through the electrolyte and a thin uniform film of copper 68 is electroplated on the interior surface of the drum, as a bonding surface for the composite layer, as shown in FIG. 10*a*. If the drum is made of copper or already has an inner copper cladding, the initial copper film may be omitted. Next, while continuing to rotate the drum, unprecoated electrically nonconductive loose boron carbide particles 70 are introduced into the cell and evenly distributed about the inner surface of the drum. This even distribution is achieved by first slowly rotating the drum and then increasing the rotational speed gradually until the boron carbide particles settle evenly on the inside surface of the drum. The optimum rate of the increase of the rotational speed for even distribution of the particles depends upon the drum diameter and amount and size of the particles. If necessary, a rake 72 as shown in FIG. 9 and FIG. 10*b* may be used to assist in spreading the layer of boron carbide particles. Introduction and uniform distribution of the particles may be done with the plating current off. The rate of rotation of the drum 60 should be at least sufficient to retain the boron carbide particles 70 in position of the inner cylindrical surface of the drum. However, it is preferred when plating to increase the rotation rate of the drum to a point where centrifugal force experienced by the particles is many hundreds of times the force of gravity. For example, with a drum five feet in diameter rotating at 1500 rpm, the centrifugal force is equivalent to 2,000 times the force of gravity. Not only does this result in a more densely packed layer of particles, but also, the convective flow of the electrolyte near the plating surface is also increased. This increased convection during the plating substantially enhances the mass transfer of the copper ions toward the cathode surface of the drum and tends to compensate for the tortuous plating paths through the densely packed particulate layer. Electrolytic entrapment of the particles builds up a composite layer 74 as electroplating continues in FIG. 10*c*. As in the vertical cells of FIG. 1 and FIG. 4, feeding the boron carbide a little at a time is preferred.

After the plating is finished the product will have a tensile component in the stainless steel drum and a compression component in the composite layer 74 due to the centrifugal force. This arrangement resembles prestressed concrete and tends to increase the mechanical strength of the unit.

Figure 10D:
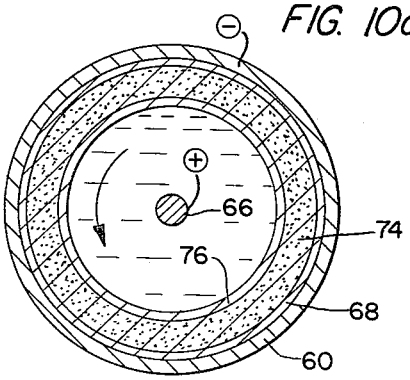

When the loose boron carbide particles have all been entrapped in the copper plating, a finish coat 76 of pure copper may be plated on the surface of the composite 74, as shown in FIG. 10*d*.

If desired, heat exchanging ductwork can be built into the composite layer while it is being formed. One technique is shown in FIG. 11 in which the cylindrical substrate or drum 78 includes integral annular parallel end portions 78*a* with aligned equally spaced openings through which parallel tubing 80 is received and held in position during the electrolytic entrapment process. If necessary, some means of electrical insulation may be provided in the openings of the annular end plates 78*a* or the end plates themselves can be formed of a nonconductive material so that the tubing 80 will be electrically isolated from the cathode surface. The electroplating procedure is the same as that shown in FIGS. 10*a* through 10*d* although the rake obviously cannot be located in the same position. Some other means of providing uniform distribution of the particles should be used, if necessary. As electroplating proceeds, the carbide particles as well as the tubing 80 is entrapped and embedded in the plated layer. If the tubing 80 is copper it becomes an integral part of the composite layer leaving holes as shown in FIG. 13. If desired, a single helical tube (not shown) can be incorporated in a similar manner with the advantage of eliminating manifolds to merge the inlets and outlets of the parallel tubes.

As shown in FIG. 14, a modified plate 30' can be constructed according to the invention using either the vertical cell in FIG. 1 or FIG. 4 to incorporate tubing 80 in a similar manner.

A thermo-mechanical method of producing a cylindrical radiation shield is illustrated in FIG. 15. Nodules 84 composed of copper encapsulated boron carbide particles are evenly spread in a layer on the inner surface of the rotating drum 60 with the help of a rake (FIG. 9) or other spreading device if necessary. If the drum 60 is stainless steel, for example, a copper film 68 should first be applied to the inside as in FIG. 10*a*. A process for making the nodules 84 is disclosed in detail in the copending application Ser. No. 901,843, which is incorporated by reference herein. As shown in FIG. 16, each nodule includes a boron carbide core 86 surrounded by a copper coating 88. The nodules are consolidated by heating the cylinder 60 and spinning it about its axis at high speed to create centrifugal force sufficient to densely compact them. In this technique it is preferred to introduce the nodules incrementally by adding batches of them to the interior of the cylinder at intervals to build up a progressively thicker composite layer.

If necessary the temperature may be raised close to the melting point of copper. A reducing atmosphere can also be used to promote bonding between the nodules. After consolidation, the inside surface of the composite should be cooled first so that its fine structure would have a high tensile component on the outer surface and act like a prestressed concrete structure.

Instead of using centrifugal force, compacting may be accomplished by a cylindrical roller 90 placed inside the drum 60 and having an axis of rotation spaced from but parallel to the axis of rotation of the drum such that when the drum rotates about its axis the small roller within rolls so as to maintain the lowest position inside the drum due to gravity. Nodules 84 of copper-clad boron carbide particles are added gradually. Heat is applied to the inside of the drum so that the combination of pressure and heat sinters the nodules together into a solid cylindrical layer. If desired, variable force can be applied to the axle of the roller in the direction of gravity by pneumatic cylinders, for example, (not shown) in which case the temperature required will depend on the force applied to the roller. The rolling operation can be carried out in an inert reducing atmosphere to promote bonding between the nodules.

These new processes for producing built-up composites of boron carbide and copper play an important role in facilitating low-cost manufacture of safe nuclear waste containers. As an alternative to precoating the boron carbide particles, the electrolytic entrapment technique permits codeposition of solid copper and boron carbide particles. In a single step the particles are surrounded by copper and bonded together into a solid composite mass. Several alternative techniques are disclosed for constructing composite cylindrical shells of boron carbide filled copper, one employing centrifugal force-aided electrodeposition through the particulate layer. Boron carbide-filled copper nodules can also be consolidated into a cylindrical composite layer by means of high centrifugal force in the presence of heat or by means of pressure from a roller within a heated rotating drum.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes that come within the meaning and range of equivalency of the claims are therefore intended to be embraced therein.

I claim:

1. A process for producing a solid cylindrical composite having a wall containing a middle layer of boron carbide-filled copper within it, comprising the steps of:

(a) providing a cylindrical metal-conductive substrate electrically connected as a cathode;

(b) providing a copper anode coaxially within the cylindrical substrate;

(c) filling the cylinder with an electrolyte suitable for plating copper;

(d) depositing a layer of electrically nonconductive particles of boron carbide on the inner wall of said electrically conductive cylindrical substrate;

(e) rotating said cylindrical substrate to apply centrifugal force to the particles on the substrate;

(f) electrolytically depositing copper onto said cylindrical substrate while said substrate is electrically connected to a circuit as a cathode by flowing electric current from the copper anode through the electrolyte to the substrate, said centrifugal force being applied to hold the particles on the substrate during deposition and aid the deposition of copper until a layer of boron carbide-filled copper of a desired thickness is achieved; and, (g) continuing the deposition of copper over the layer of boron carbide-filled copper to form an inner layer of copper on the cylindrical composite.

2. The process as set forth in claim 1, wherein said substrate includes stainless steel.

3. The process as set forth in claim 1, wherein said substrate includes copper.

4. The process as set forth in claim 1, wherein said substrate includes copper foil.

5. The process as set forth in claim 1, wherein said substrate includes copper mesh.

6. The process as set forth in claim 1, wherein prior to depositing the particles, a layer of copper is electrodeposited on said substrate.

7. The process as set forth in claim 1, further comprising the step of:

prior to depositing said particles, arranging tubing adjacent to said substrate so that it will be incorporated into the composite layer.

8. The process as set forth in claim 7, wherein said tubing is arranged in spaced juxtaposition to said substrate.

9. The process as set forth in claim 8, wherein said tubing is parallel to said substrate.

10. The process as set forth in claim 8, wherein said tubing is copper.

11. The process as set forth in claim 1 wherein steps (d) through (f) are repeated consecutively until achieving a predetermined thickness of said composite boron carbide-filled layer.

12. The process as set forth in claim 1, further comprising the step of:

spreading said particles in a uniform layer on the inner cylindrical surface of said substrate while rotating said substrate.

13. The process as set forth in claim 12, wherein the cylinder is rotated slowly while spreading said particles in a layer and rapidly while electrolytically depositing copper therethrough.

14. The process as set forth in claim 11 wherein steps (d) through (f) are repeated consecutively until achieving a predetermined thickness of said boron carbide-filled layer such that this layer contains 10–50 weight percent boron carbide.

15. The process as set forth in claim 14 including the step of consolidating said boron carbide-filled copper layer.

* * * * *